US008871325B1

(12) United States Patent
Fernandez

(10) Patent No.: US 8,871,325 B1
(45) Date of Patent: Oct. 28, 2014

(54) WEB ASSEMBLY FOR MAKING AND MAINTAINING A CONTOUR OF A BASEBALL OR A SOFTBALL GLOVE

(76) Inventor: Derek Wayne Fernandez, Glendora, CA (US)

( * ) Notice: Subject to any disclaimer, the term of this patent is extended or adjusted under 35 U.S.C. 154(b) by 251 days.

(21) Appl. No.: 13/593,346

(22) Filed: Aug. 23, 2012

Related U.S. Application Data

(60) Provisional application No. 61/595,420, filed on Feb. 6, 2012.

(51) Int. Cl.
*B32B 5/04* (2006.01)
*B32B 3/24* (2006.01)

(52) U.S. Cl.
USPC ..... 428/100; 428/99; 223/78

(58) Field of Classification Search
CPC ..... A63B 71/14
USPC ..... 428/100, 99; 223/78; 2/19
See application file for complete search history.

(56) References Cited

U.S. PATENT DOCUMENTS

| | | | |
|---|---|---|---|
| 5,346,208 | A | 9/1994 | Wood, Sr. |
| 5,456,390 | A | 10/1995 | McFarland |
| 5,672,127 | A | 9/1997 | Danz |
| 5,758,805 | A | 6/1998 | Dunn |

FOREIGN PATENT DOCUMENTS

| | | | |
|---|---|---|---|
| JP | 2000-014857 | A | 1/2000 |
| JP | 2007-202711 | A | 8/2007 |

OTHER PUBLICATIONS

May 13, 2013 International Search Report and Written Opinion of Korean Intellectual Property Office.

*Primary Examiner* — Alexander Thomas
(74) *Attorney, Agent, or Firm* — Plager Schack LLP

(57) ABSTRACT

A web assembly can be used for making and maintaining a contour of a baseball or softball glove. The web assembly comprises a plurality of horizontal straps comprising a top strap and a bottom strap mechanically coupled to a plurality of vertical straps comprising a left strap and a right strap. A right durable strap and left durable strap are mechanically coupled to at least one horizontal strap where the at least one horizontal strap is further mechanically coupled to the right strap and the left strap. In this manner, a user can wrap the web assembly around the glove and affix the right durable strap to the left durable strap with a hook and loop fastener, and allowing for the straps to deform slightly to make and maintain the contour of the glove.

2 Claims, 2 Drawing Sheets

WEB ASSEMBLY FOR MAKING AND MAINTAINING A CONTOUR OF A BASEBALL OR A SOFTBALL GLOVE

CROSS REFERENCE TO RELATED APPLICATIONS

This application claims priority to U.S. Provisional Application 61/595,420 filed on Feb. 6, 2012.

FIELD OF THE INVENTION

This invention relates to sports equipment. In particular, this relates to material used to form baseball or softball gloves.

BACKGROUND OF THE INVENTION

The prior art teaches that the best way to form a baseball or softball glove is with a series of straps that can be tightened or loosened independent of one another. This is needlessly time consuming and wrongheaded.

U.S. Pat. No. 5,672,127 issued to Danz teaches a device to form and maintain a glove shape, comprising, elastic straps mechanically coupled to one another by stitching and a hook and loop fastener. U.S. Pat. No. 6,430,746 issued to Watson teaches a panel member having a plurality of straps where the straps are mechanically coupled to a panel member by a hook and loop fastener. U.S. Pat. No. 5,758,805 issued to Dun teaches a strapping assembly comprising a pair of parallel straps cross connected at their ends with hook and vane cross fasteners. Unlike Danz, Dunn only has fasteners on straps in the parallel direction. None of these devices teach a separately sewn leather or vinyl section. Further each of these devices teaches away from the single unit teaching in the present invention with a needlessly complicated and ineffective plurality of straps.

BRIEF SUMMARY OF THE INVENTION

A web assembly can be used for making and maintaining a contour of a baseball or softball glove. The web assembly comprises a plurality of horizontal straps comprising a top strap and a bottom strap mechanically coupled to a plurality of vertical straps comprising a left strap and a right strap. A right durable strap and left durable strap are mechanically coupled to at least one horizontal strap where the at least one horizontal strap is further mechanically coupled to the right strap and the left strap. In this manner, a user can wrap the web assembly around the glove and affix the right durable strap to the left durable strap with a hook and loop fastener, and allowing for the straps to deform slightly to make and maintain the contour of the glove.

BRIEF DESCRIPTION OF THE SEVERAL VIEWS OF THE DRAWINGS

Figure 1:
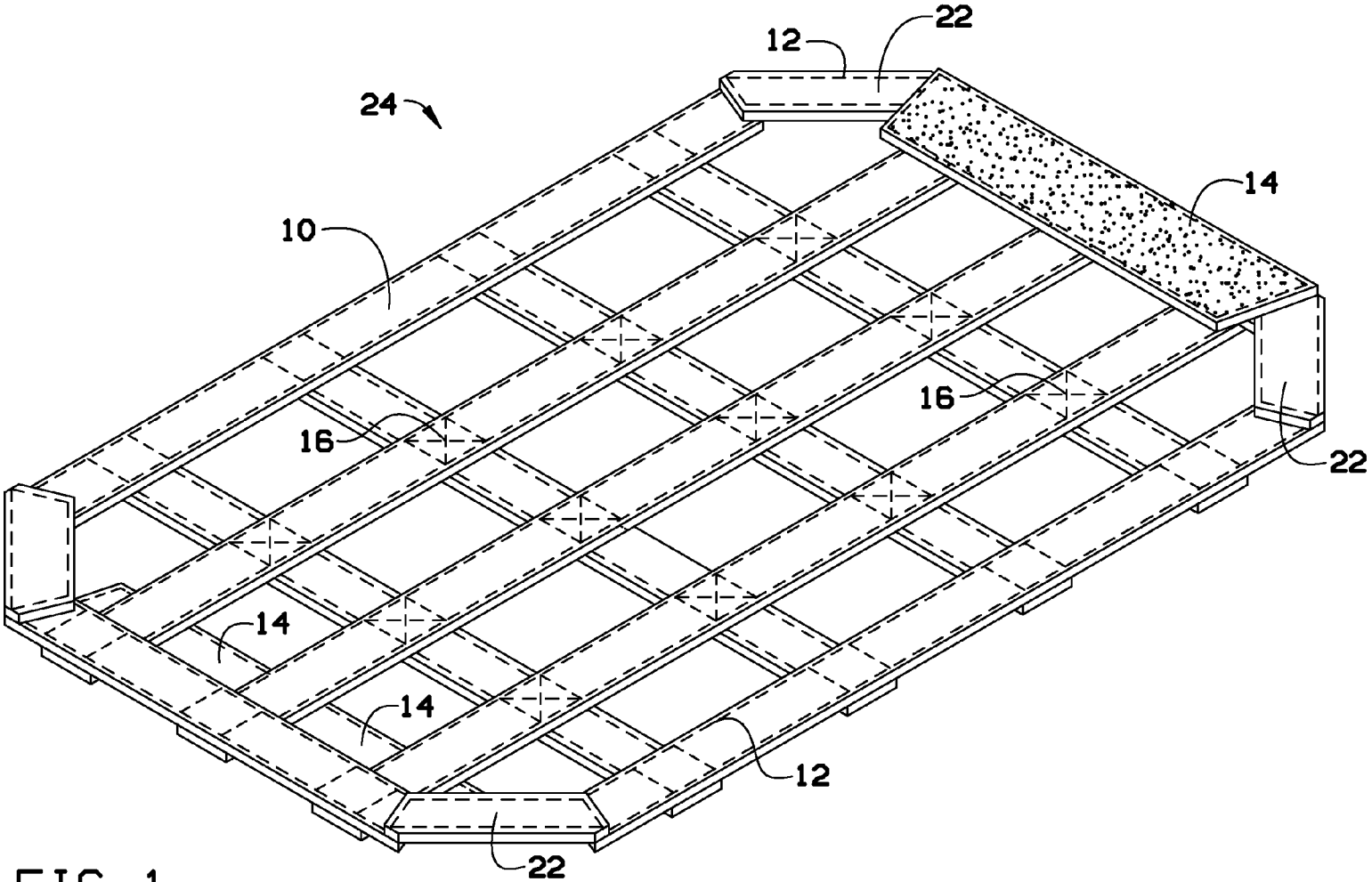

Having thus described the invention in general terms, reference will now be made to the accompanying drawings, which are not necessarily drawn to scale, and wherein:

FIG. 1 is a perspective view of the invention.

Figure 2:
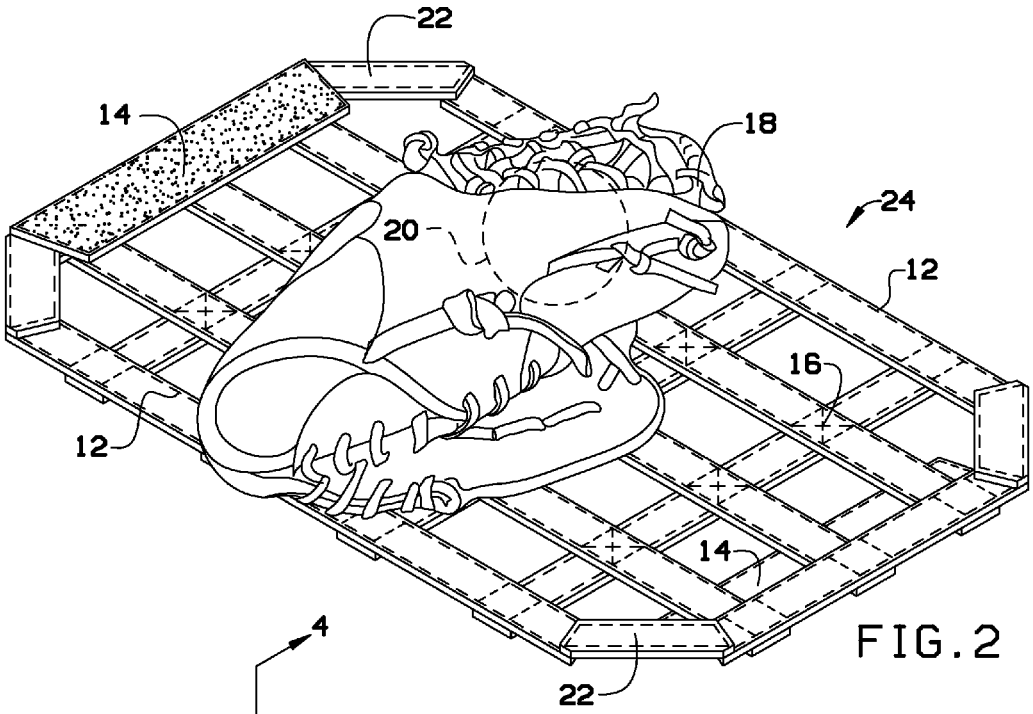

FIG. 2 is a perspective view of the invention shown in pre-folded configuration and illustrating placement of a glove.

Figure 3:
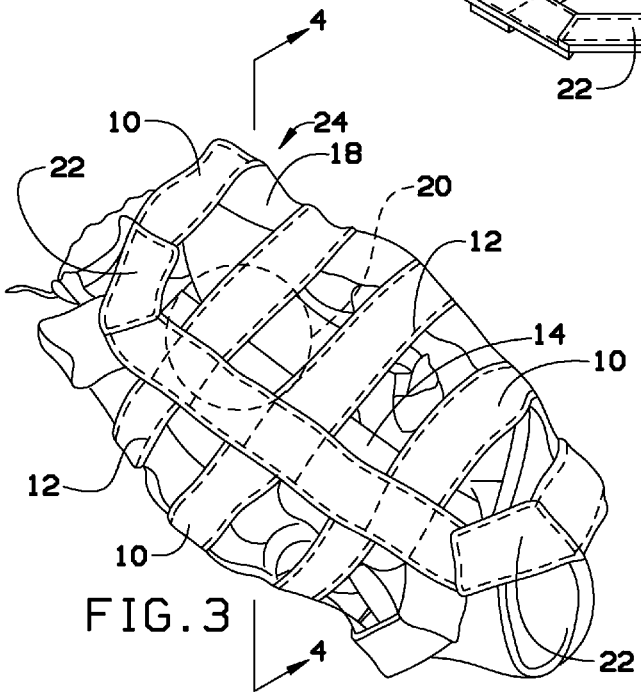

FIG. 3 is a perspective view of the invention shown in folded configuration and illustrating placement of a glove and a ball.

Figure 4:
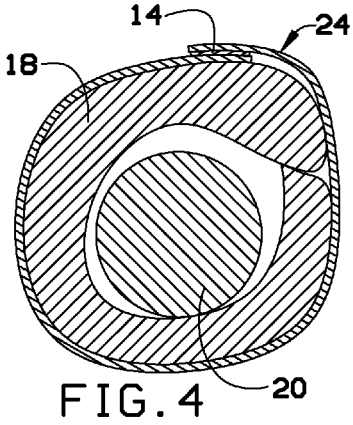

FIG. 4 is a section detail view of the invention along line 4-4 in FIG. 3.

DETAILED DESCRIPTION OF THE INVENTION

Embodiments of the present invention overcome many of the obstacles associated with forming baseball and softball gloves, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows a perspective view of the invention. Web assembly 24 comprises a plurality of straps 10 laid in a cross sectional pattern with overlapping straps mechanically coupled to cross-stitching 16. The plurality of straps further comprises a plurality of horizontal straps 10 and a plurality of vertical straps 10.

The plurality of horizontal straps 10 further comprises a top strap 10 and a bottom strap 10. Top strap 10 is mechanically coupled to top right corner strap 22 by stitching 12 and top left corner strap 22 by stitching 12. Likewise, bottom strap 10 is mechanically coupled to bottom right corner strap 22 by stitching 12 and bottom left corner strap 22 by stitching 12.

Bottom left corner strap 22 and top left corner strap 22 are further mechanically coupled to left strap 10 by stitching 12. Likewise, bottom right corner strap 22 and top right corner strap 22 are further mechanically coupled to right strap 10 by stitching 12.

Right durable strap 14 is mechanically coupled to at least one horizontal strap 10 by heavy duty stitching where at least one horizontal strap 10 is further mechanically coupled to right strap 10 by stitching 12. Likewise, left durable strap 14 is mechanically coupled to at least one horizontal strap 10 by heavy duty stitching where at least one horizontal strap 10 is further mechanically coupled to left strap 10 by stitching 12.

In the preferred embodiment, straps 10 and corner straps 22 are made from elastic webbing. Stitching 12 is made from an elastic thread stitching, cross stitching 16 is made from an elastic thread cross-stitching. Durable strap 14 is made from leather which is thicker than straps 10 and corner straps 22.

FIG. 2 shows web assembly 24 with glove 18 covering ball 20. Right durable strap 14 is covered with a hook fastener with heavy duty stitching and left durable strap 14 is covered with a loop fastener with heavy duty stitching. In this manner, a user can wrap web assembly 24 around glove 18 holding ball 20 and affix right durable strap 14 to left durable strap 14 with a hook and loop fastener. This forms glove 18 as shown in FIG. 3 and FIG. 4.

FIG. 3 and FIG. 4 show glove 18 holding call 20 wrapped by web assembly 24. One advantage over the prior art is that the stitching 12 can slightly deform and stitching 16 can deform to a lesser extent to put pressure on glove 18 in a manner contrary to the prior art. The prior art solution is to use a series of individual straps to put pressure on different points of glove 18. This assumes that a user is able to calibrate the tension necessary in each strap without any sort of measuring. The present invention removes this guesswork by simply having straps deform as needed to form glove 18. Further, the inconsistent nature of individual strap tensions exacerbates a user's ability to maintain the contour of glove 18. The present invention solves that problem with a consistent applied web assembly 24.

That which is claimed:

1. A web assembly for making and maintaining a contour of a baseball or softball glove, the web assembly comprising, a plurality of horizontal straps comprising a top strap and a bottom strap mechanically coupled to a plurality of vertical straps comprising a left strap and a right strap;

the top strap is attached to the left strap by a top left corner strap; the top strap is attached to the right strap by a top right corner strap; the bottom strap is attached to the left strap by a bottom left corner strap; the bottom strap is attached to the right strap by a bottom right corner strap;

a right durable strap is mechanically coupled to at least one horizontal strap where the at least one horizontal strap is further mechanically coupled to the right strap; a left durable strap is mechanically coupled to the at least one horizontal strap by heavy duty stitching where the at least one horizontal strap is further mechanically coupled to the left strap;

the right durable strap is covered with a hook fastener and the left durable strap is covered with a loop fastener;

in this manner, a user can wrap the web assembly around the glove and affix the right durable strap to the left durable strap with a hook and loop fastener, and allowing for the straps to deform slightly to make and maintain the contour of the glove.

2. The web assembly of claim 1, the plurality of horizontal straps are mechanically coupled to the plurality of vertical straps by an elastic thread cross-stitching; the plurality of horizontal straps and the plurality of vertical straps are otherwise lined with elastic thread stitching; this allows for greater and more consistent deformation of the straps to better make and maintain the contour of the glove.

* * * * *